US005531188A

United States Patent [19]

Tomasulo

[11] Patent Number: 5,531,188

[45] Date of Patent: Jul. 2, 1996

[54] CLEANING SYSTEM FOR REMOVAL OF SOLUBLE HYDROCARBON RESIDUE FROM SURFACES

[76] Inventor: James Tomasulo, 9570 Southern Bell Dr., Brooksville, Fla. 34613

[21] Appl. No.: 100,133

[22] Filed: Aug. 2, 1993

[51] Int. Cl.[6] ..... F22B 7/18

[52] U.S. Cl. ..... 122/379; 15/316.1; 122/392

[58] Field of Search ..... 165/95; 15/316 A; 122/379, 392

[56] References Cited

U.S. PATENT DOCUMENTS

| | | | |
|---|---|---|---|
| 2,324,804 | 7/1943 | Van Gelderen | 141/1 |
| 2,348,465 | 5/1944 | Geiringer | 141/6 |
| 3,046,163 | 7/1962 | Kearney et al. | 134/11 |
| 4,696,073 | 9/1987 | Urbania | 15/302 |
| 5,017,240 | 5/1991 | Brown | 134/22.1 |
| 5,041,165 | 8/1991 | Urbania . | |

*Primary Examiner*—Henry A. Bennet
*Assistant Examiner*—Susanne C. Tinker
*Attorney, Agent, or Firm*—A. W. Fisher, III

[57] ABSTRACT

A cleaning system to remove soluble hydrocarbon residue and other contaminants from essentially nonporous objects or surfaces including a vapor generating chamber having a vapor generating system and a gas flow control disposed therein to generate a solvent vapor to clean the nonporous surfaces and control the flow of gas through the vapor generating chamber respectively, and a system control to control the vapor concentration or humidity of the solvent vapor.

30 Claims, 4 Drawing Sheets

CLEANING SYSTEM FOR REMOVAL OF SOLUBLE HYDROCARBON RESIDUE FROM SURFACES

BACKGROUND OF THE INVENTION

1. Field of the Invention

A cleaning system to remove soluble hydrocarbon residue and other contaminants from essentially nonporous objects or surfaces.

2. Description of the Prior Art

Various vapor generating apparatus have been designed to clean barges, tanker ships, rail tank cars, refineries and storage tank farms. Increasingly stringent worker safety and waste disposal regulations have created an environment in which alternative methods of large-scale cleaning of hydrocarbon residues and hazardous wastes are dictated and essential.

Presently, the predominant cleaning method employs the use of high pressure water systems. Such systems require workers to physically enter tanks containing hazardous residues. Because of the danger to workers, OSHA has strengthened regulations relating to confined entry (Occupational Safety and Health Standards, Part 1910, Subsection 146). These regulations now require such costly safety equipment and procedures that the market is eagerly searching for ways to adopt new cleaning systems which minimize or eliminate the need for workers to enter tanks.

Moreover, the large volume of water and waste material generated by these high water pressure water systems must be handled and processed. Because of past abuses, new EPA regulations sharply limit or control the disposal of the waste material by such cleaning systems.

U.S. Pat. No. 4,332,626 describes a process for removal of oxidizable liquid organic chemical residue from large vessels by a non-catalytic method comprising heating the vessel by introducing a heat source and oxygen into the interior of the vessel wherein the emitted heat volatizes substantially all and decomposes at least a portion of the oxidizable liquid organic chemical contaminating the interior of the vessel. The vessel combustion gas resulting from the volatilization and decomposition of the liquid organic chemical is fed from the vessel, filtered and vented to the atmosphere combustion gas essentially free of the particulates and oxidizable organic chemical.

U.S. Pat. No. 3,046,163 shows a method of cleaning the interior of a tank holding oil, grease, crude petroleum products, coal tar products, resinous products, paints or plasticizers comprising the steps of first passing hot vapor of a chlorinated hydrocarbon solvent into the tank and condensing the vapor on the tank walls dissolving adhering dissolvable matter on the interior surfaces of the tank and loosening clinging solid deposits; draining off the contaminated condensation formed and recovering the solvent; pressure spraying the interior of the tank with chlorinated hydrocarbon solvent in liquid form to remove the clinging matter loosened during the first step, draining the sludge formed from the tank and recovering the solvent from the sludge; passing hot chlorinated hydrocarbon solvent vapor into the tank, and passing unheated outside air through the tank to purge it of solvent odors and recovering the remaining traces of solvent vapor from the air before releasing the air into the atmosphere.

U.S. Pat. No. 2,348,465 teaches a process for removing grease and oil from the surfaces comprising the steps of diminishing the pressure in a closed space adjacent a surface to be cleaned, admitting the vapor of a solvent and condensing the solvent vapor on the surface, the vapor being admitted under pressure to increase the speed of condensation; cooling the surface to further increase the speed of the process; drawing off the condensed solvent and continuing the operation until nearly clean solvent drains off; shutting off the influx of vapor and extracting the last remainders of condensed solvent by diminishing the pressure to produce a high degree of vacuum and evaporating the remaining solvent and sucking off the vapor created by such final flashing-out, and applying heat to increase the speed of the evaporation and the removal.

U.S. Re. 20,976 describes a generator for use with a steam coil or other source of heat for vaporizing the solvents for cleaning surfaces within a tank comprising heating an oil solvent to form a vapor under pressure, delivering the solvent vapor into the tank displacing a horizontal layer of the air at the top of the tank while leaving the body of air in the tank below the solvent vapor as a means for retarding the speed of descent of the vapor, continuing the initial delivery of the solvent vapor to build up pressure within the tank, and after an interval sufficient to permit the air to rise to the top portion of the tank above the descended heavier solvent vapor, discharging the air from the tank by relieving the pressure.

U.S. Pat. No. 5,017,240 teaches a method for the removal and recovery of hydrocarbons which are contained within the air/vapor mixture in bulk oil or gasoline storage tanks using fractional condensation with cryogenic cooling.

Additional examples of the prior art are found in U.S. Pat. Nos. 2,324,804; 4,696,073 and U.S. Pat. No. 5,041,165.

Unfortunately the prior art exhibits the various danger or drawbacks to both workers and the environment as well as limited effectiveness of the cleaning process.

In contrast, the present invention requires no entry by workers into tanks, substantially reduces the volume of waste removed from tanks, significantly reduces cleaning time and allows cleaning in a wide range of climates including sub-freezing weather.

SUMMARY OF THE INVENTION

The present invention relates to a cleaning system to remove soluble hydrocarbon soils and other entrapped contaminents from objects or surfaces such as the interior surfaces of a land storage tank or pipe line. The cleaning system and solvent reservoirs may be mounted on a trailer to facilitate movement from site to site.

The cleaning system comprises a vapor generating chamber having a vapor generating means and a gas flow control means disposed therein and a system control means to control overall system operation.

The vapor generating means comprises a plurality of solvent injectors and vaporizing heat source coupled to an external heat source to heat the interior of the vapor generating chamber. The plurality of solvent injectors are disposed to spray a mist of solvent into the vapor generating chamber to be vaporized by the vaporizing heat source.

The gas flow control means comprises a flow control and a directional control disposed at opposite ends of the vapor generating chamber. The flow control comprises a fan within the vapor generating chamber to circulate air and vaporized solvent through the vapor generating chamber and the land storage tank; the directional control comprises a louver mechanism mounted adjacent or within the inlet port to selectively direct the flow of air into the vapor generating chamber.

The overall operation of the cleaning status is controlled by a system control means. The efficiency and efficacy of the cleaning apparatus is dependent largely on the vapor concentration or humidity within the land storage tank or pipe line that is dependent upon the temperature or heat within the vapor generating chamber, velocity of air flow through the vapor generating chamber and quantity or volume of solvent injected in the vapor generating chamber through the solvent injections by the solvent fuel pump. Therefore the heat source, solvent feed pump, gas flow control means and directional control are operatively coupled to a central processing unit including logic means to selectively control the operation of each of the components independent of each other to establish and maintain a preselected vapor concentration or humidity within the land storage tank or pipe line. A system sensor means comprising a plurality of operation conditions or state sensors disposed throughout the system are coupled to the central processing unit to monitor the system operation. Specifically, the plurality of operating conditions or state sensors includes an air flow sensor, a temperature sensor, a vapor concentration sensor and a remote vapor concentration sensors connected to the central processing unit such that the signals corresponding to the operating conditions generated by the various sensors are fed to the central processing unit to control the operation of each of the operating components.

Vapor cleaning is a physical method of removing solvent soluble soils and other entrapped soils from metal, glass and other essentially nonporous objects. By bringing the soiled articles at room temperature into contact with hot solvent vapor, the vapor condenses to a liquid on them. Sufficient liquid solvent is formed to carry the soluble and insoluble soils away as the solvent drains by gravity.

To use, the cleaning system is coupled to the land storage tank or pipe line.

The cleaning system is initialized to an initial level of operation with the external heat source, solvent feed pump, and fan and motor combination energized and with the louver in the open position. As the vaporized solvent is circulated through the vapor generating chamber and the land storage tank or pipe line, the vapor concentration within the land storage tank or pipe line is sensed by the first remove vapor concentration sensor. The vapor concentration or humidity may be increased or decreased by varying the solvent fed to the solvent injectors varying the speed of air flow through the vapor generating chamber by adjusting the flow control and/or directional control, and/or by varying the heat supplied to the vapor generating chamber by the external heat source.

Air and vapor may be selectively withdrawn from the land storage tank or vapor generating chamber through a gas removal or recovery device by moving or positioning the first valve means and second valve means respectively to a second position.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
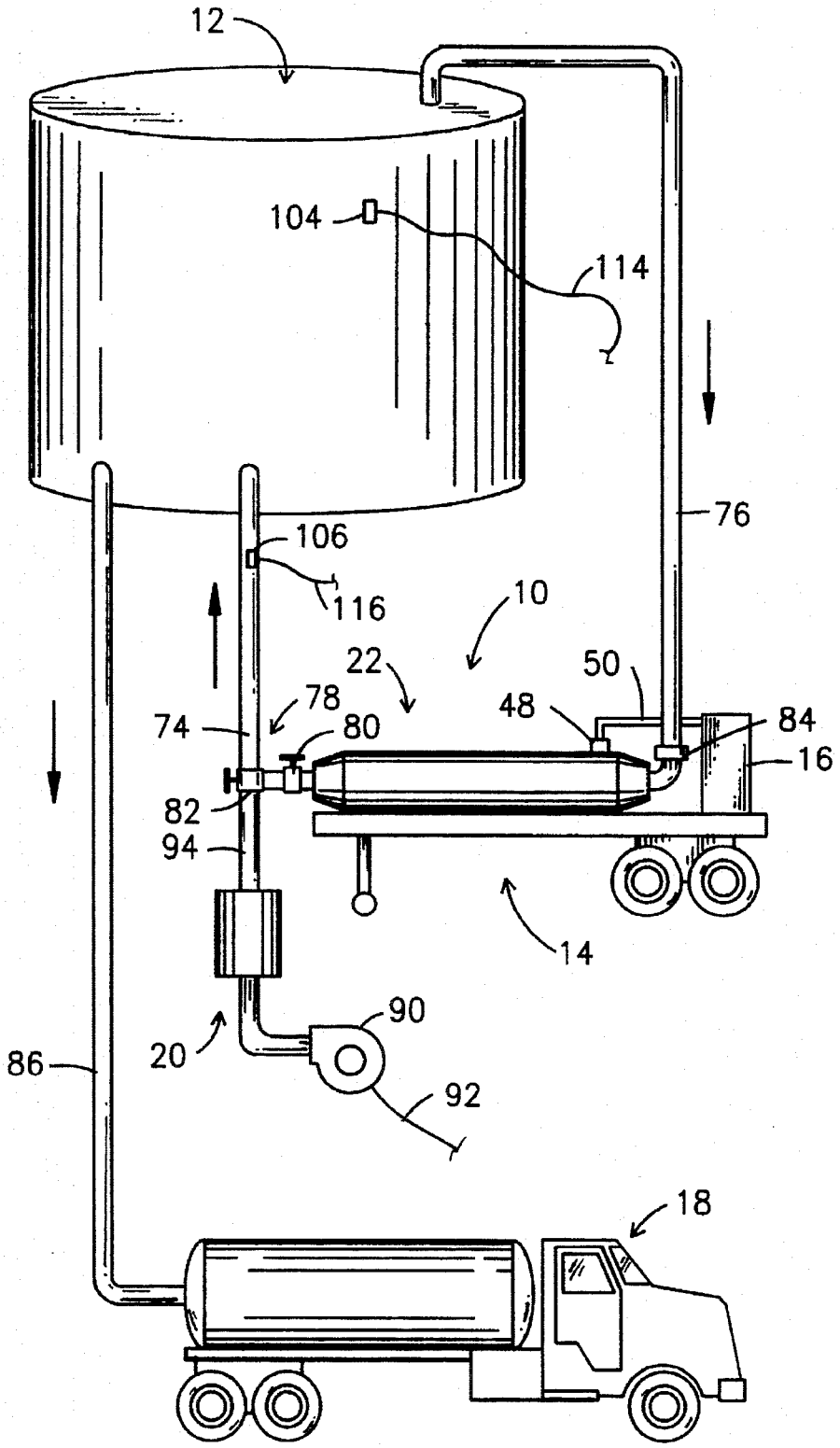
FIG. 1 shows the cleaning system of the present invention deployed to clean soluble residue from the interior surface of a storage tank.

As shown in FIG. 1, the present invention relates to a cleaning system generally indicated as 10 to remove soluble hydrocarbon soils and other entrapped contaminents from essentially nonporous objects or surfaces such as the interior surfaces of a land storage tank generally indicated as 12. The cleaning system 10 may be mounted on a trailer generally indicated as 14 to facilitate movement from site to site. As described more fully hereinafter, an external solvent reservoir 16 provides liquid solvent such as tetrachloroethylene to the cleaning apparatus 10. Of course, a separate external solvent reservoir or tank (not shown) may be used. In addition, a mobile waste disposal unit generally indicated as 18 may be coupled to the land storage tank 12 to receive the effluent therefrom. A gas removal or recovery device generally indicated as 20 may be provided to withdraw gas or vapor from the cleaning apparatus 10 and the land tank 12 as described more fully hereinafter.

Figure 2:
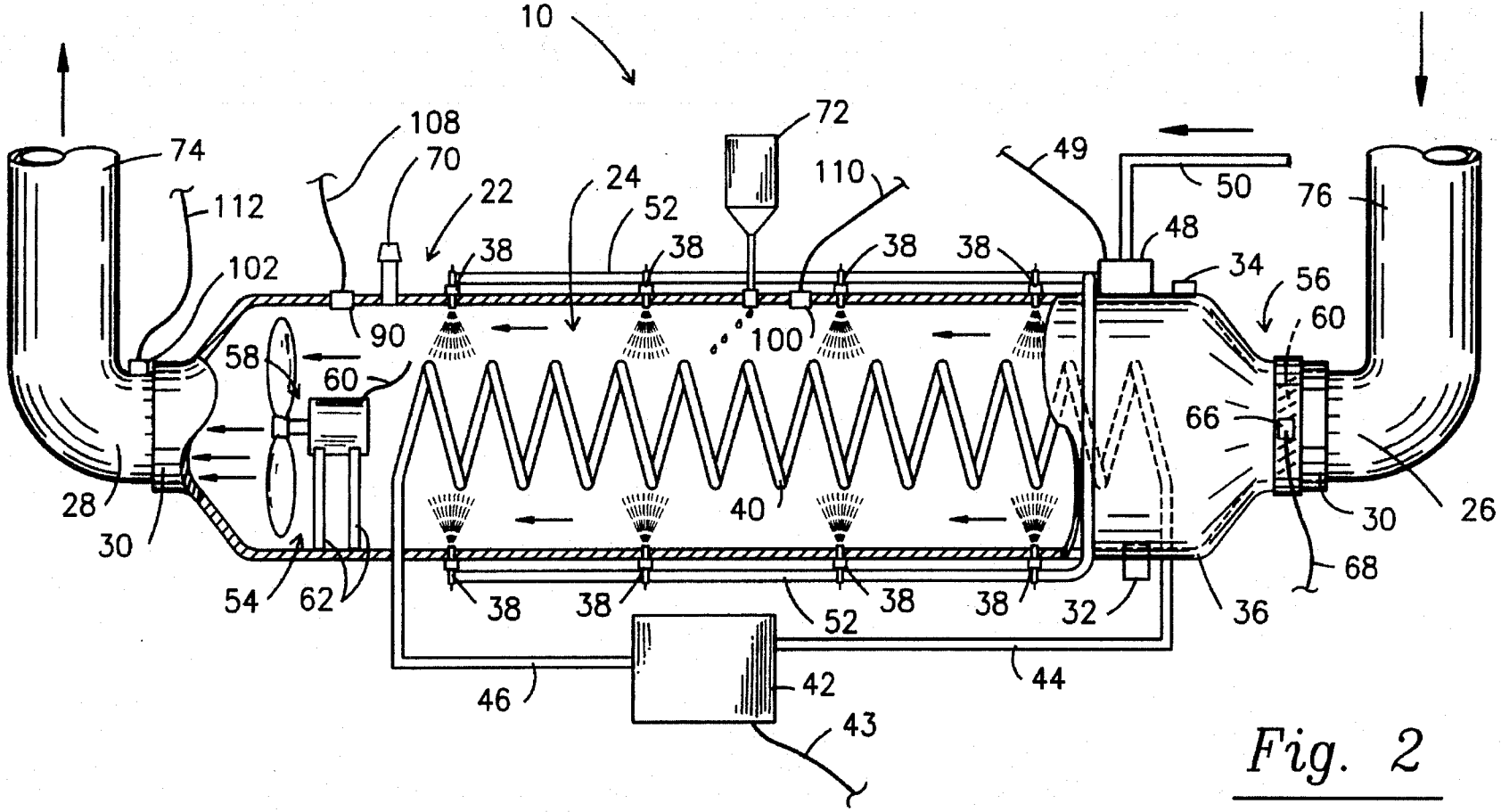
FIG. 2 is a partial detailed cross-sectional side view of the cleaning system of the present invention.

As best shown in FIG. 2, the cleaning system 10 comprises an elongated substantially cylindrical tank or enclosure generally indicated as 22 including a vapor generating chamber 24 having a vapor generating means and a gas flow control means disposed therein and a system control means to control overall system operation. An inlet port 26 and outlet port 28 are formed on opposite ends of the elongated substantially cylindrical tank or enclosure 22. A hose fitting 30 extends outwardly from each end of the elongated substantially cylindrical tank or enclosure 22 axially aligned with the inlet port 26 and outlet port 28. A fluid drain 32 and an air inlet 34 are formed in the shell 36 of the elongated substantially cylindrical tank 22.

The vapor generating means comprises a plurality of solvent injectors each indicated as 38 mounted to the elongated substantially cylindrical tank or enclosure 22. The vaporizing heat source comprises a cork screw configured steam heat coil 40 coupled to an external heat source such as a steam supply 42 by a steam supply conduit 44 and a steam return conduit 46 to heat the interior of the vapor generating chamber 24. Of course, other heat sources may be substituted for the external steam supply 42. The plurality of solvent injectors 38 are disposed to spray a mist of solvent into the vapor generating chamber 24 to be vaporized by the cork screw configured steam heat coil 40.

The plurality of solvent injectors 38 are coupled to the external solvent reservoir 16 by a liquid solvent supply means. The liquid solvent supply means comprises a solvent feed pump 48 connected to a power source (not shown) by a conductor 49 are coupled to the external solvent reservoir or tank 16 by a solvent supply conduit 50 and to the plurality of solvent injectors 38 by one or more solvent feed conduits 52 to feed pressurized solvent to the plurality of solvent injectors 38.

The gas flow control means comprises a flow control generally indicated as 54 and a directional control generally indicated as 56 disposed at opposite ends of the vapor generating chamber 24.

The flow control 54 comprises a fan and motor combination coupled to a power source (not shown) by a conductor 60 mounted within the vapor generating chamber 24 on supports 62 to circulate air and vaporized solvent through the vapor generating chamber 24 and the land storage tank 12. The directional control 56 comprises a louver mechanism 64 coupled to a positioning means or motor 66 connected to a power source (not shown) by a conductor 68 mounted adjacent or within the inlet port 26 to selectively direct the flow of air into the vapor Generating chamber 24 as discussed more fully hereinafter.

A pressure relief valve 70 and a liquid dye supply 72 are mounted on the shell 52 and in communication with the vapor generating chamber 24. The pressure relief valve 70 will vent overpressure within the vapor Generating chamber 24; while, the liquid dye supply 72 can selectively inject a colored medium into the vapor generating chamber 24 to be introduced into the air and vaporized solvent to provide a means to detect leaks within the cleaning system 10.

As best shown in FIG. 1, the elongated substantially cylindrical tank or enclosure 22 is coupled to the land storage tank 12 by a vapor solvent supply conduit 74 and a vapor solvent return conduit 76 to circulate vaporized solvent from the vapor generating chamber 24 through the land storage tank 12. The flow of vapor from and to the vapor generating chamber 24 is controlled by a first valve means generally indicated as 78 including a first control valve 80 and a second control valve 82 operatively coupled to the vapor solvent supply conduit 74 and the vapor solvent return conduit 76 and a second valve means 84 respectively.

Also as shown in FIG. 1, the mobile waste disposal unit 18 is coupled to the land storage tank 12 by an effluent conduit 86 to selectively withdraw effluent including the soluble hydrocarbon residue cleaned or removed from the interior surfaces of the land storage tank 12 by the vaporized solvent as described more fully hereinafter.

As shown in FIG. 1, the gas removal or recovery device 20 comprises a filter 88 and vacuum pump 90, connected to a power source (not shown) by a conductor 92, coupled to the vapor generating chamber 24 and the interior of the land storage tank 12 through the first valve means 78 and gas withdrawal conduit 94.

Figure 3:
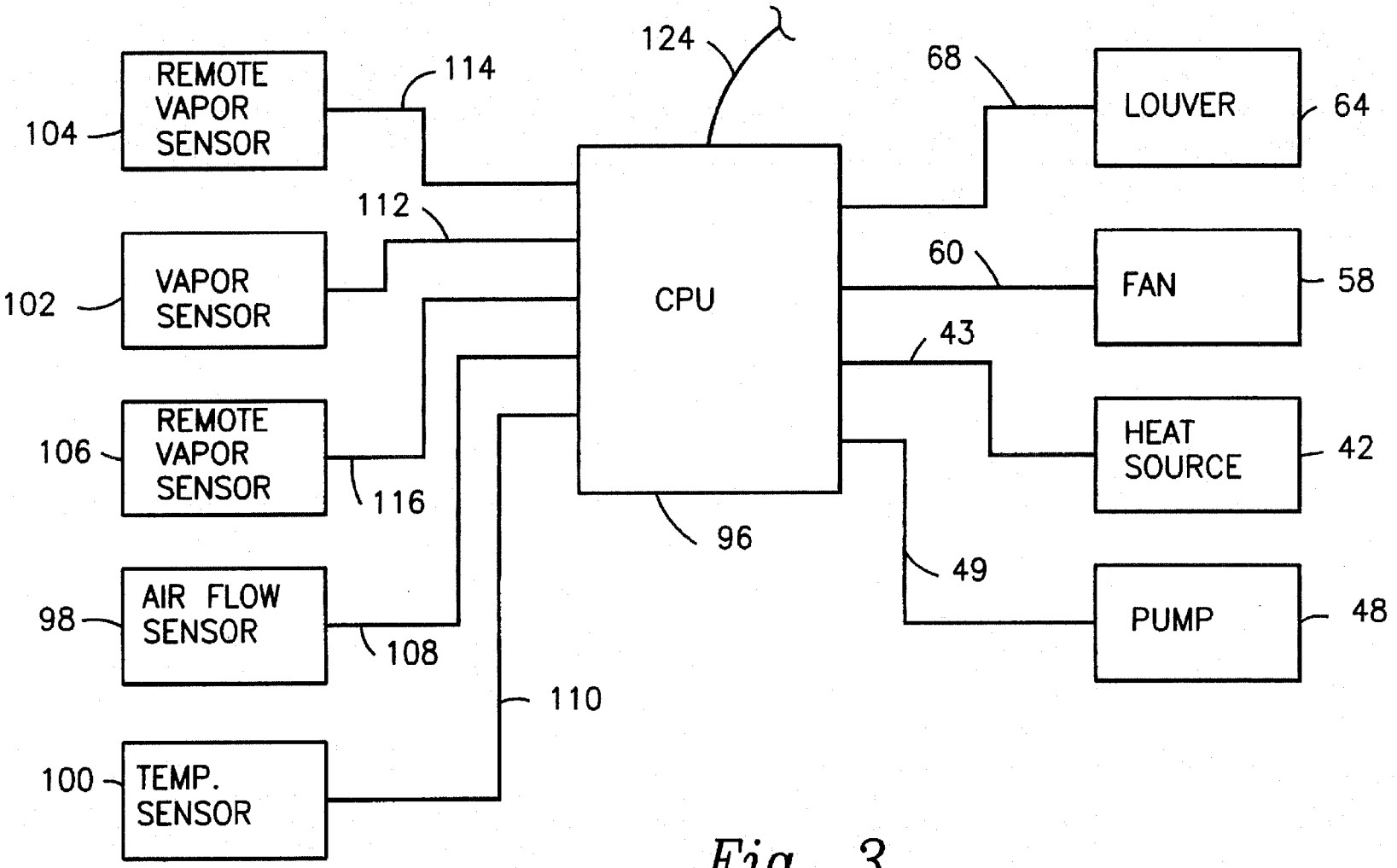
FIG. 3 is a schematic block diagram of the system control means of the present invention.

The overall operation of the cleaning status 10 is controlled by a system control means shown schematically in FIG. 3. The efficiency and efficacy of the cleaning apparatus 10 is dependent largely on the vapor concentration or humidity within the land storage tank 12 that is dependent upon the temperature or heat within the vapor generating chamber 24, velocity of air flow through the vapor generating chamber 24 and quantity or volume of solvent injected in the vapor generating chamber 24 through the solvent injections 38 by the solvent fuel pump 48. Therefore the heat source 42, solvent feed pump 48, gas flow control means (fan/motor 58) and directional control (positioning means 64) are operatively coupled to a central processing unit 96 including logic means to selectively control the operation of each of the components independent of each other to establish and maintain a preselected vapor concentration or humidity within the land storage tank 12. These components may be coupled to the central processing unit 96 by the conductors previously described. Alternately separate conductors can be employed. A system sensor means comprising a plurality of operation conditions or state sensors disposed throughout the system are coupled to the central processing unit 96 to monitor the system operation. Specifically, the plurality of operating conditions or state sensors includes an air flow sensor 98, a temperature sensor 100, a vapor concentration sensor 102, a first remote vapor concentration sensor 104 and a second remote vapor concentration sensor 106 connected to the central processing unit 96 through conductors 108, 110, 112,114 and 116 respectively such that the signals corresponding to the operating conditions generated by the various sensors are fed to the central processing unit 96 to control the operation of each of the operating components.

Figure 4:
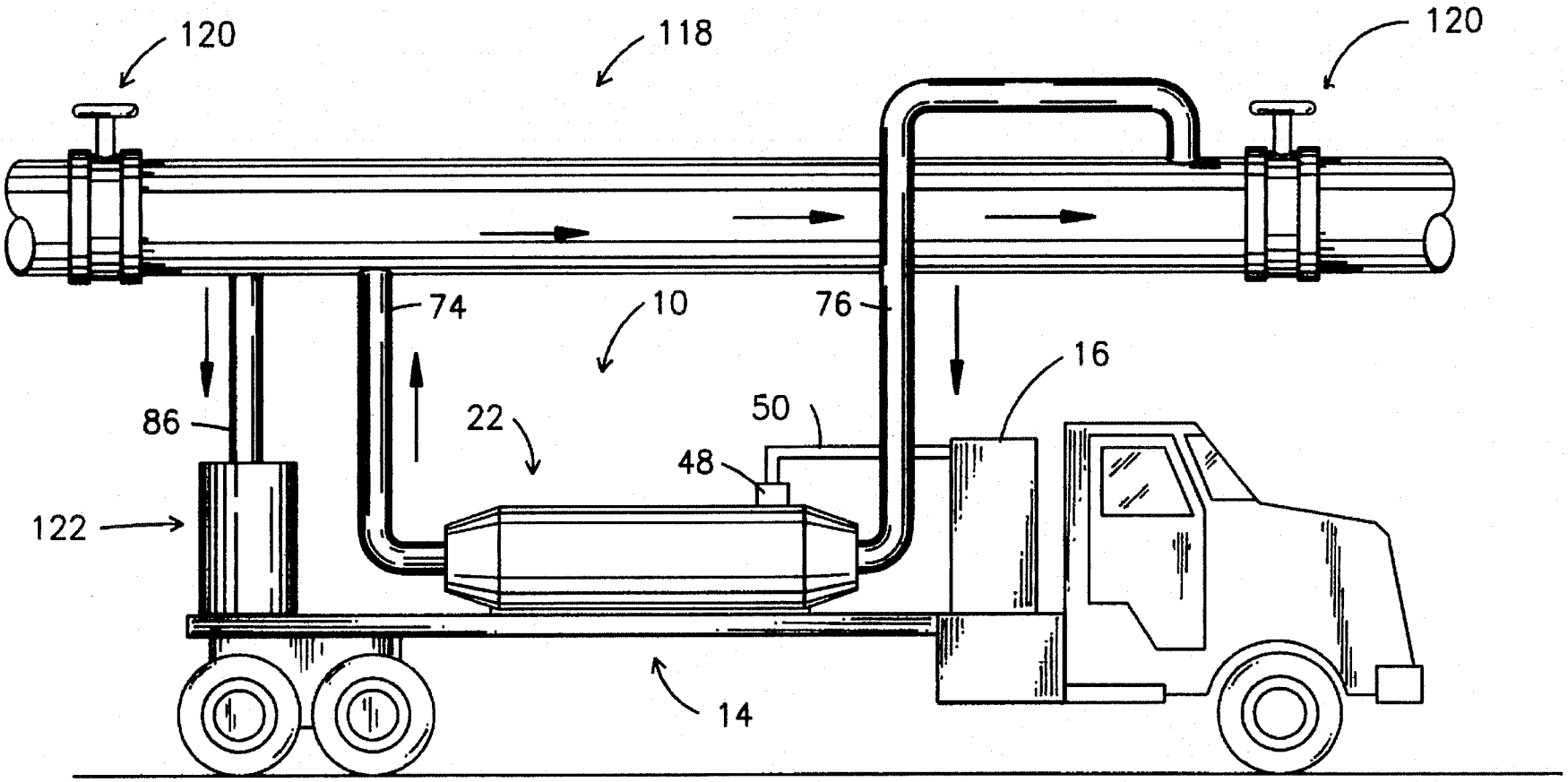
FIG. 4 shows the cleaning system of the present invention deployed to clean soluble residue from the interior surface of a pipe line.

FIG. 4 shows an alternate embodiment of the cleaning system 10. Specifically, the elongated substantially cylindrical tank or enclosure 22 is coupled to a pipe line 118 with shut-off valves 120 by the vapor solvent supply conduit 74 and the vapor solvent return conduit 76 to 13 circulate vaporized solvent from the vapor generating chamber 24 through a section of the pipe line 118 isolated by the shut-off valve 120.

A waste disposal unit 122 is coupled to the pipe line 118 by the effluent conduit 86 to selectively withdraw effluent including the soluble hydrocarbon residue cleaned or removed from the interior surfaces of the pipe line 118 by the vaporized solvent.

Vapor cleaning is a physical method of removing solvent soluble soils and other entrapped soils from metal, glass and other essentially nonporous objects. By bringing the soiled articles at room temperature into contact with hot solvent vapor, the vapor condenses to a liquid on them. Sufficient liquid solvent is formed to carry the soluble and insoluble soils away as the solvent drains by gravity.

To use, the cleaning system 10 is coupled to the land storage tank 12 or pipe line 118 as previously described. In operation, the central processing unit 96 is coupled to a power source (not shown) by a conductor 124.

The cleaning system 10 is initialized to an initial level of operation with the external heat source 42, solvent feed pump 48, and fan and motor combination 58 energized and with the louver 64, first valve means 80 and second valve means 84 in the open position. As the vaporized solvent is circulated through the vapor generating chamber 24 and the land storage tank 12, the vapor concentration within the land storage tank 12 is sensed by the first remote vapor concentration sensor 104. The vapor concentration or humidity may be increased or decreased by varying the solvent fed to the solvent injectors 38 by the solvent feed pump 48, varying the speed of air flow through the vapor generating chamber 24 by adjusting the flow control 54 and/or directional control 56, and/or by varying the heat supplied to the vapor generating chamber 24 by the external heat source 42. A system equilibrium is sought by determining and maintaining a vapor maintenance temperature to minimize the cleaning time and chemical residue.

Air and vapor may be selectively withdrawn from the land storage tank 12 or vapor generating chamber 24 through the gas removal or recovery device 20 by moving or positioning the first valve means 78 and second valve means 84 respectively to a second position.

In addition to tank cleaning, the present invention provides a method for paint stripping of industrial parts and fittings such as paint skids in automobile production. Parts are placed in an artificial tank or room and then cleaned by circulation solvent vapors inside the tank. The vapors break the chemical bonds between paint and the metal surface, causing the paint to separate from the parts being cleaned in dry flakes, which accumulate on the tank floor. The paint chips are then vacuum-collected for resale back to the paint manufacturer.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A cleaning system to remove soluble hydrocarbon residue from the surfaces in land storage tanks through the generation and circulation of vaporized solvent, said cleaning system comprising a vapor generating chamber having a vapor generating means and a gas flow control disposed therein to generate a solvent vapor to clean the surfaces and control the flow of gas through the vapor generating chamber respectively, a gas recovery device comprising a filter and vacuum pump coupled to said vapor generating chamber and the interior of the land storage tank to exhaust air and vapor therefrom, and a system control to control the vapor concentration of the solvent vapor circulated throughout said cleaning system and land storage tank.

2. The cleaning system of claim 1 wherein said vapor generating means comprises a plurality of solvent injectors disposed to spray a mist of solvent into said vapor generating chamber and a vaporizing heat source to heat the interior of said vapor generating chamber to vaporize the solvent.

3. The cleaning system of claim 2 wherein said plurality of solvent injectors are coupled to an external solvent reservoir by a liquid solvent supply means.

4. The cleaning system of claim 3 wherein said liquid solvent supply means comprises a solvent feed pump coupled to an external solvent reservoir by a solvent supply conduit and to said plurality of solvent injectors by at least one solvent feed conduits to feed pressurized solvent to said plurality of solvent injectors.

5. The cleaning system of claim 1 wherein said vapor generating chamber is formed within an elongated shell.

6. The cleaning system of claim 5 wherein said gas flow control means comprises a flow control means and a directional control means disposed at opposite ends of said elongated shell.

7. The cleaning system of claim 6 wherein said flow control means comprises a fan within said vapor generating chamber to circulate air and vaporized solvent through said vapor generating chamber and the land storage tank.

8. The cleaning system of claim 7 wherein said directional control means comprises a louver mechanism coupled to a positioning means mounted adjacent an inlet port formed in said shell to selectively direct the flow of air into said vapor generating chamber.

9. The cleaning system of claim 5 wherein said elongated shell is coupled to the land storage tank by a vapor solvent supply conduit and a vapor solvent return conduit to recirculate vaporized solvent through said vapor generating chamber and the land storage tank.

10. The cleaning system of claim 9 further including a pressure relief valve mounted on said shell and in communication with said vapor generating chamber to vent overpressure in said vapor generating chamber.

11. The cleaning system of claim 10 further including a liquid dye supply mounted on said shell and in communication with said vapor generation chamber to inject a colored medium into said vapor generating chamber to provide a means to detect leaks within said cleaning system.

12. The cleaning system of claim 6 wherein said system control comprises a central processing unit including logic means to selectively control the operation of said vaporizing heat source, said solvent feed pump, said gas flow control and said directional control independent of each other to establish and maintain a preselected vapor concentration or humidity within the land storage tank.

13. The cleaning system of claim 12 wherein the system sensor means comprises a plurality of state sensors disposed throughout said cleaning system and coupled to the central processing unit to monitor the system operation.

14. The cleaning system of claim 13 wherein said plurality of state sensors include an air flow sensor, a temperature sensor, a vapor concentration sensor and at least one remote vapor concentration sensor.

15. The cleaning system of claim 13 wherein said feed signals corresponding to the operating conditions generated by said state sensors are fed to said central processing unit to control the operation of each of said operating components.

16. A cleaning system to remove soluble hydrocarbon residue from the surfaces in land storage tanks through the generation and circulation of vaporized solvent, said cleaning system comprising a vapor generating chamber having a vapor generating means and a gas flow control disposed therein to generate a solvent vapor to clean the surfaces and control the flow of gas through the vapor generating chamber respectively, and a system control comprising a central processing unit including logic means to selectively control the operation of said vaporizing heat source, said solvent feed pump and said gas flow control independent of each other to establish and maintain a preselected vapor concentration of the solvent vapor circulated throughout the cleaning system and land storage tank.

17. The cleaning system of claim 16 wherein said vapor generating means comprises a plurality of solvent injectors disposed to spray a mist of solvent into said vapor generating chamber and a vaporizing heat source to heat the interior of said vapor generating chamber to vaporize the solvent.

18. The cleaning system of claim 17 wherein said plurality of solvent injectors are coupled to an external solvent reservoir by a liquid solvent supply means.

19. The cleaning system of claim 18 wherein said liquid solvent supply means comprises a solvent feed pump coupled to an external solvent reservoir by a solvent supply conduit and to said plurality of solvent injectors at least one solvent feed conduit to feed pressurized solvent to said plurality of solvent injectors.

20. The cleaning system of claim 16 wherein said vapor generating chamber is formed within an elongated shell.

21. The cleaning system of claim 20 wherein said gas flow control means comprises a flow control means and a directional control means disposed at opposite ends of said elongated shell.

22. The cleaning system of claim 21 wherein said flow control means comprises a fan within said vapor generating chamber to circulate air and vaporized solvent through said vapor generating chamber and the land storage tank.

23. The cleaning system of claim 22 wherein said directional control means comprises a louver mechanism coupled to a positioning means mounted adjacent an inlet port formed in said shell to selectively direct the flow of air into said vapor generating chamber.

24. The cleaning system of claim 20 wherein said elongated shell is coupled to the land storage tank by a vapor solvent supply conduit and a vapor solvent return conduit to recirculate vaporized solvent through said vapor generating chamber and the land storage tank.

25. The cleaning system of claim 25 further including a pressure relief valve mounted on said shell and in communication with said vapor generating chamber to vent overpressure in said vapor generating chamber.

26. The cleaning system of claim 25 further including a liquid dye supply mounted on said shell and in communication with said vapor generation chamber to inject a colored medium into said vapor generating chamber to provide a means to detect leaks within said cleaning system.

27. The cleaning system of claim 16 further including a gas removal/recovery device comprising a filter and vacuum pump coupled to said vapor generating chamber and the interior of the land storage tank to exhaust air and vapor therefrom.

28. The cleaning system of claim 16 wherein the system sensor means comprises a plurality of state sensors disposed throughout said cleaning system and coupled to the central processing unit to monitor the system operation.

29. The cleaning system of claim 28 wherein said plurality of state sensors include an air flow sensor, a temperature sensor, a vapor concentration sensor and at least one remote vapor concentration sensor.

30. The cleaning system of claim 28 wherein said feed signals corresponding to the operating conditions generated by said state sensors are fed to the central processing unit to control the operation of each of said operating components.

* * * * *